US006282863B1

(12) United States Patent
Christian et al.

(10) Patent No.: US 6,282,863 B1
(45) Date of Patent: Sep. 4, 2001

(54) SCAFFOLDLESS TANK ERECTION METHOD

(75) Inventors: Harold B. ("Scott") Christian, Palm Harbor, FL (US); William R. Easter, Cherokee, AL (US)

(73) Assignee: Chicago Bridge and Iron, Plainfield, IL (US)

( * ) Notice: Subject to any disclaimer, the term of this patent is extended or adjusted under 35 U.S.C. 154(b) by 0 days.

(21) Appl. No.: 09/109,628

(22) Filed: Jul. 2, 1998

(51) Int. Cl.[7] ..... E04G 21/00

(52) U.S. Cl. ..... 52/747.1; 52/747.12; 52/745.01; 52/745.1; 52/127.2; 182/36; 182/37; 182/128

(58) Field of Search ..... 52/745.1, 247, 52/245, 127.2, 169.7, 745.01, 745.17, 747.12, 295, 747.1; 182/36, 37, 128

(56) References Cited

U.S. PATENT DOCUMENTS

| | | | | |
|---|---|---|---|---|
| 884,813 | * | 4/1908 | Gordnier | 182/36 |
| 1,265,966 | * | 5/1918 | Schlafly | 52/742 |
| 2,433,335 | * | 12/1947 | Boardman | 52/745.1 |
| 2,852,110 | * | 9/1958 | Dueringer | 52/742 |
| 2,975,927 | * | 3/1961 | Arne | 52/745.1 |
| 3,391,757 | * | 7/1968 | Duke et al. | 182/63 |
| 3,471,053 | * | 10/1969 | Endicott et al. | 52/745.1 |
| 3,620,331 | * | 11/1971 | Shaw | 182/150 |
| 3,637,047 | * | 1/1972 | Cox | 182/36 |
| 3,880,315 | * | 4/1975 | Nelson et al. | 220/1 |
| 4,142,284 | | 3/1979 | Steuber . | |
| 4,164,268 | * | 8/1979 | Jones et al. | 182/150 |
| 4,225,012 | * | 9/1980 | Hindle | 182/37 |
| 4,788,803 | * | 12/1988 | Seitz | 52/741 |
| 4,828,073 | * | 5/1989 | Friday | 182/36 |
| 5,009,052 | * | 4/1991 | Welch | 52/742 |
| 5,148,605 | * | 9/1992 | Julia | 33/370 |
| 5,271,482 | * | 12/1993 | Walz | 182/63 |
| 5,590,497 | * | 1/1997 | Moore | 52/223.3 |

FOREIGN PATENT DOCUMENTS 2 096 227 10/1982 (GB) .

OTHER PUBLICATIONS

International search report dated Oct. 20, 2000.

* cited by examiner

*Primary Examiner*—Beth A. Stephan
*Assistant Examiner*—Dennis L. Dorsey
(74) *Attorney, Agent, or Firm*—Marshall, O'Toole, Gerstein, Murray & Borun

(57) ABSTRACT

A method of erecting the shell of an aboveground storage tank involves erection of the first shell ring; erecting the second and higher shell rings by using a mobile man lift to provide access for the construction personnel to the shell plates being erected; and anchoring the structure to reduce the risk of blow-ins from ambient wind.

24 Claims, 13 Drawing Sheets

SCAFFOLDLESS TANK ERECTION METHOD

BACKGROUND OF THE INVENTION

The present invention relates generally to aboveground storage tanks, and more specifically to a method of constructing a tank. Unlike conventional methods, the present method does not require the use of scaffolds to provide either: (1) access to the shell plates for construction personnel; or (2) resistance to buckling damage from ambient wind during shell construction.

Aboveground storage tanks typically consist of a circular, essentially flat bottom and a vertical cylindrical shell having a lower edge that is joined to the tank bottom. The shell of a conventional storage tank consists of a stack of rings that are joined together at girth seams. Each shell ring is constructed of shell plates that are joined together at vertical seams. Tanks typically have a fixed roof that may be cone-shaped or dome-shaped and is joined to the top of the shell, or a floating roof that floats on the product stored in the tank.

During construction of the shell, it is conventional to use scaffold brackets to attach a scaffold to the outside or inside surface of the shell. The scaffold provides construction personnel with access to the shell plates during their placement in the shell rings and for fit-up and welding of vertical seams and girth seams between plates. Conventionally, a scaffold is initially mounted on the first shell ring and is consecutively "jumped" upwards as work progresses to higher shell rings.

The use of scaffolds for constructing a tank shell has a number of disadvantages. The scaffold consists of many components that must be fabricated, maintained in working order, stored in a construction equipment warehouse, shipped to the tank construction site, installed on the shell rings, moved to higher shell rings during construction of the higher shell rings, removed from the tank after tank construction, and sent back to a construction equipment warehouse for repair, maintenance, and storage until the next tank construction project. Time and effort is also required to remove the scaffold bracket straps after use, and to grind smooth any remaining weld burrs on the shell plates. The time required to successively jump a scaffold to higher shell rings alone adds significantly to the time needed to construct a tank shell. It is thus desirable to find an alternative tank construction method that does not require the use of a scaffold.

One consideration has weighed in favor of continuing the use of scaffolding. As wind flows over a cylindrical tank shell, it produces an air pressure on the upwind surface of the tank shell that is higher than the local barometric pressure at the tank site. It also produces an air pressure on the downwind surface of that same tank shell that is lower that the local barometric pressure. This differential of air pressures tends to cause the shell to deflect inwardly on the upwind side of the tank. While a tank is being constructed, the shell may lack adequate rigidity to prevent such wind-produced air pressures from causing the shell to buckle. A scaffold that completely encircles the shell during construction can, if properly designed and installed, provide the shell with resistance to such buckling. This is described, for example, in Vaughn, et al., U.S. Pat. No. 3,908,793.

SUMMARY OF THE INVENTION

According to the present invention, an aboveground storage tank can be constructed without the expense of a scaffold. A mobile manlift and carriages suspended from the top edge of the plates are used to provide the necessary access for hanging, fitting, and welding the shell plates of the upper rings.

Additional resistance to tank shell buckling, if necessary, can be provided by anchoring the tank shell to the foundation, such as through the use of individual shell anchors spaced around the lower portion of the first shell ring. If a concrete ringwall is used as part of the tank foundation, the shell anchors may be attached to the concrete Tingwall. Alternatively, shell anchors may be attached to the soil, for example with auger soil anchors. Stiffening may also be provided by guys lines or by adding stiffeners at critical heights on the sides of the tank while it is being erected.

DETAILED DESCRIPTION OF THE INVENTION

Figure 1:
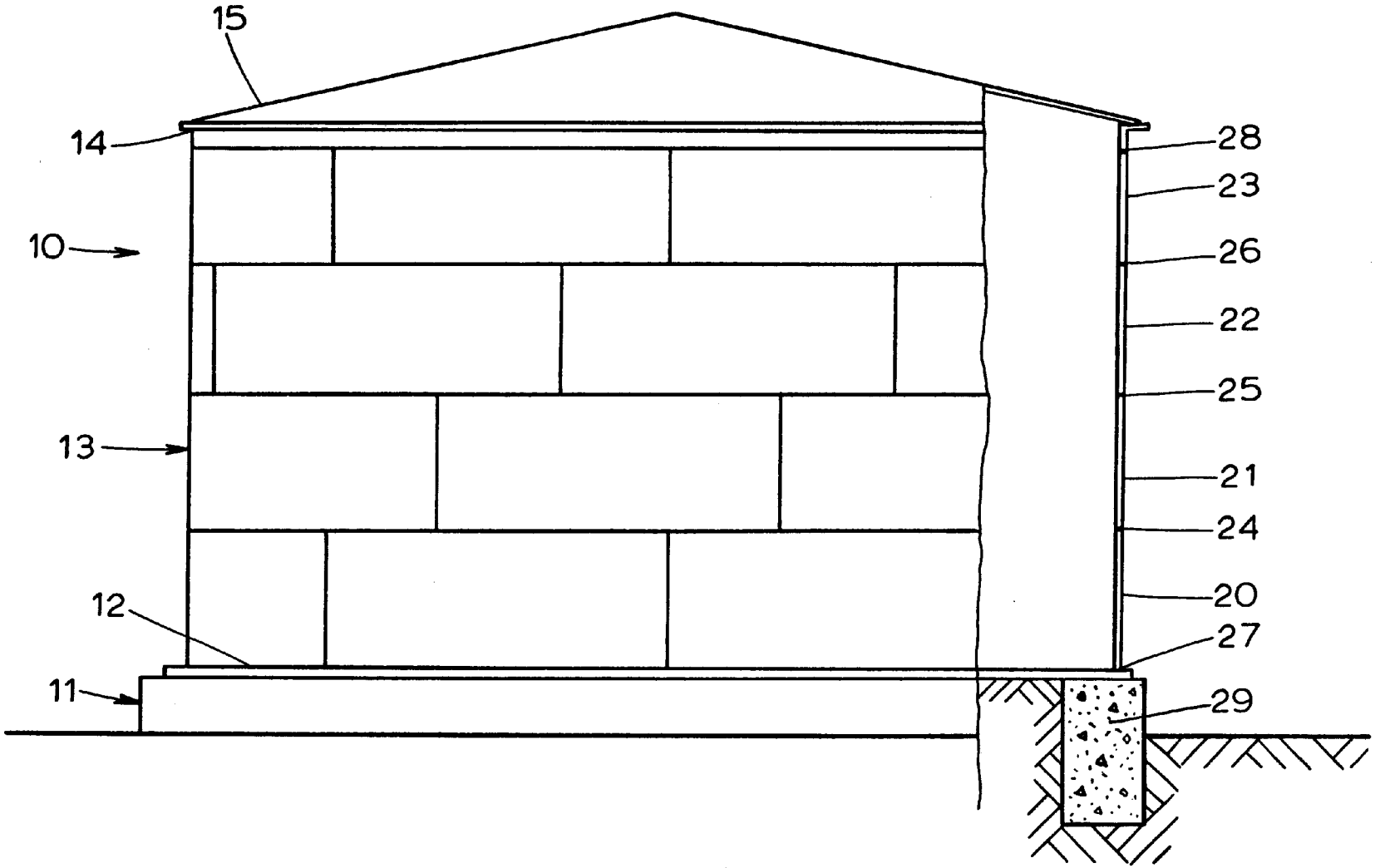
FIG. 1 is an elevational view of a typical aboveground fixed-roof storage tank, with a partial section view of the tank shell.

The new construction method can be used in connection with a variety of types of storage tanks, including both fixed roof tanks and floating roof tanks. As illustrated in FIG. 1, a typical aboveground fixed-roof storage tank [10] consists of a foundation [11], a circular bottom [12] that rests on the foundation [11], a vertical cylindrical shell [13] that is joined at its lower edge to the outer perimeter of the bottom [12], a top angle [14] with a vertical leg that is joined to the top edge of the shell [13], and a roof [15] that is joined at its outer perimeter to a horizontal leg of the top angle [14].

The shell [13] that has been illustrated here consists of four rings [20, 21, 22, 23] of shell plates. The first, lowermost ring [20] rests on the bottom [12] and is joined to the bottom [12] by a corner seam [27]. The second ring [21]

rests on the first ring [20] and is joined to it by a first girth seam [24]. The third ring [22] rests on the second ring [21] and is joined to it by a second girth seam [25]. The top, fourth ring [23] rests on the third ring [22] and is joined to it by a third girth seam [26]. The top angle [14] rests on the fourth ring [23] and is joined to it by a top angle girth seam [28].

The foundation [11] illustrated here includes a concrete ringwall [29], although the method can also be used with tanks that are not built on a ringwall.

Tank Bottom

Figure 2:
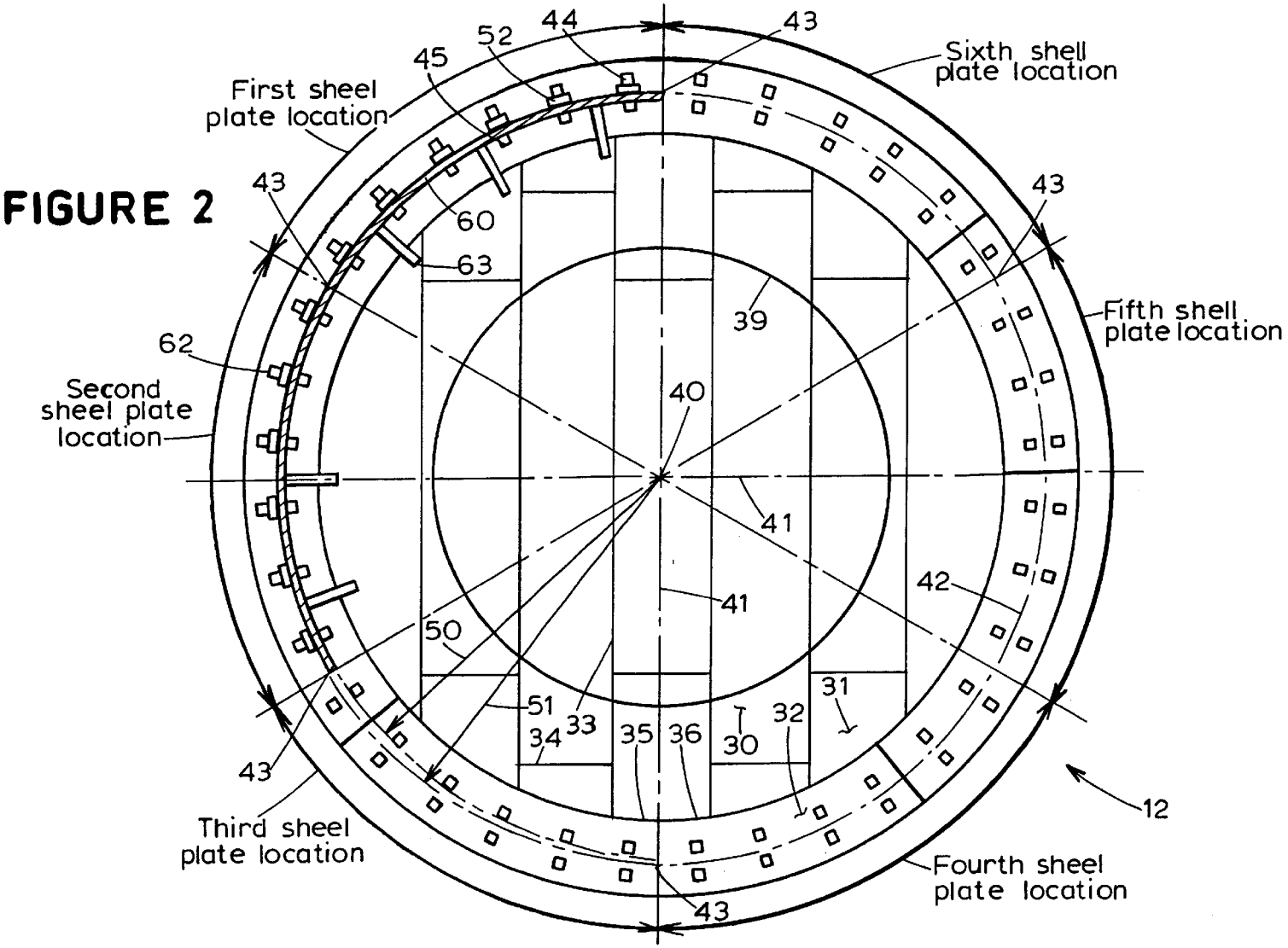
FIG. 2 is a plan view of the bottom of the tank illustrated in FIG. 1, showing an arrangement of bottom plates and a layout for the first ring.

FIG. 2 illustrates one of a variety of possible configurations for a bottom of a tank in connection with which the present method may be used. As illustrated, the tank bottom [12] consists of rectangular plates [30], sketch plates [31], and annular plates [32]. The rectangular plates [30] are located in the center area of the tank bottom [12] and do not extend to the annular plates [32]. The rectangular plates [30] are arranged so that they overlap adjacent rectangular plates [30] and are joined together with lap-welded rectangular plate seams [33]. The sketch plates [31] are located in the area between the rectangular plates [30] and the annular plates [32]. The sketch plates [31] are arranged so that they underlap adjacent sketch plates [31] and adjacent rectangular plates [30] and are joined together and to the rectangular plates [30] with lap-welded sketch plate seams [34]. The annular plates [32] are located near the perimeter of the tank bottom [12] and underlap the adjacent sketch plates [31]. The annular plates [32] are joined together by butt-welded annular plate seams [35] and are joined to the adjacent sketch plates [31] by lap-welded annular plate seams [36]. The layout of the bottom plates is not important to the invention, and many other layouts could be used.

First Ring

FIG. 2 also shows the layout for the first ring [20]. Before beginning construction of the tank shell, it is useful to mark the tank center [40] on the tank bottom [12]. It is also useful to mark the tank centerlines [41] on the tank bottom [12]. Using the tank center [40] as a reference, a first ring inside circumference [42] may be marked on the tank bottom [12] at the first ring plate inside radius [50]. First ring vertical seam locations [43] may also be marked on the first ring inside circumference [42]. As described below, it may also be useful to mark a circular track [39] approximately 15 to 20 feet from the inside circumference [42].

Figure 3:
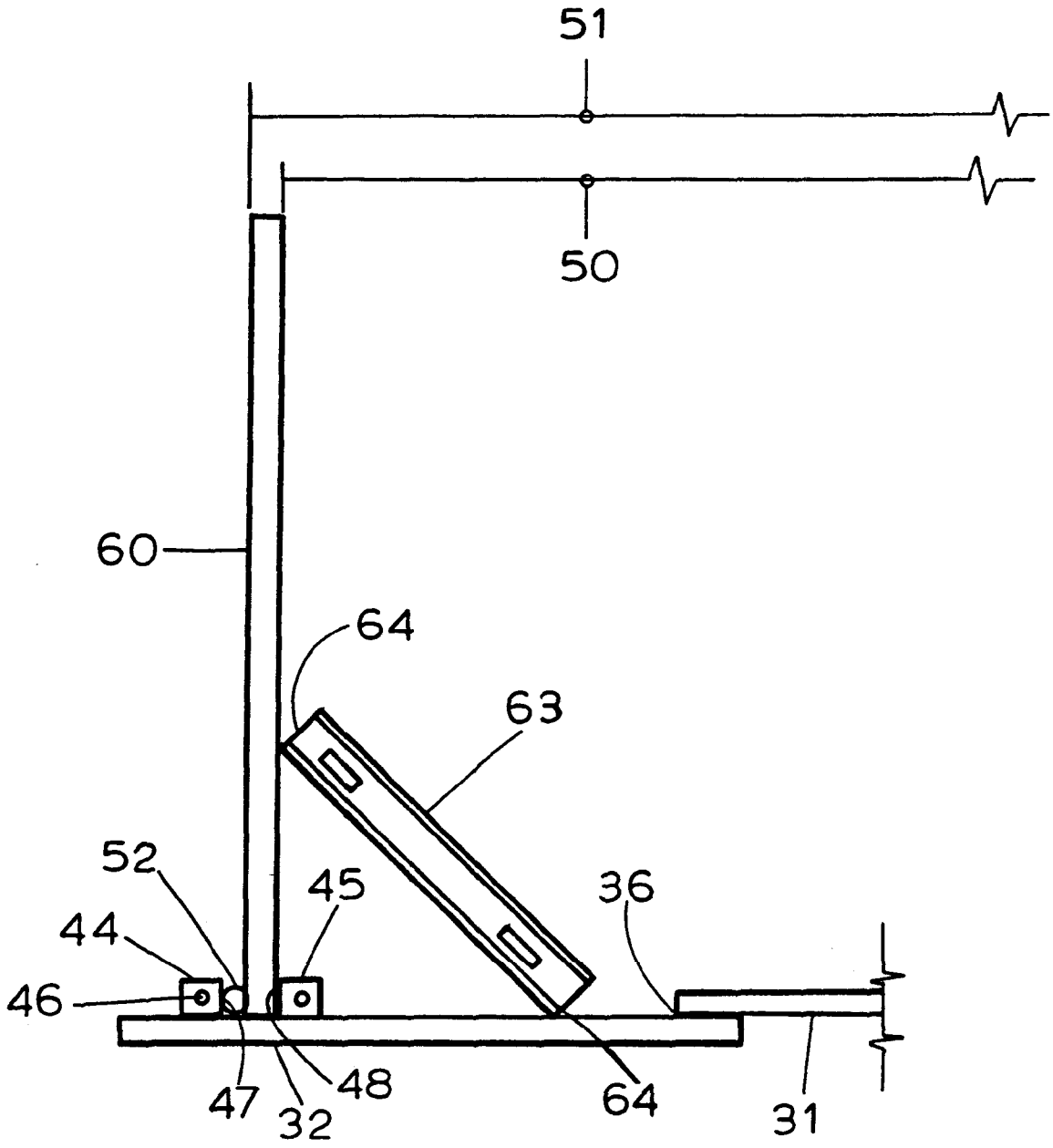
FIG. 3 is an elevational section indicated by section 1—1 in FIG. 2, illustrating a method of positioning the first ring plates.

As seen in FIG. 3, outside key nuts [44] and an inside positioner in the form of inside key nuts [45] are tack-welded to the annular plates [32] so that the centerline axes of the key nut holes [46] (FIG. 3) are oriented tangentially to the tank shell [13]. Preferably, the inside key nuts [45] are positioned with an outside edge [48] located at the first ring inside circumference [50], and the inside edge [47] of the outside key nuts [44] are positioned about ¾ inches outwardly of an outside circumference [51] of the first ring. The sets of key nuts are spaced no more than about 4 to 5 feet apart, with a set of nuts about 18 inches from each vertical seam location [43]. As illustrated in FIG. 2, there are six outside key nuts [44] and six inside key nuts [45] for each first ring shell plate [60], with equal spacing between the nuts for each shell plate.

The inside positioner could take other forms. For example, instead of key nuts, a bar, angle, channel member, or other member could be used to set the inside circumference.

Preparing the First Ring Shell Plates

Figure 4:
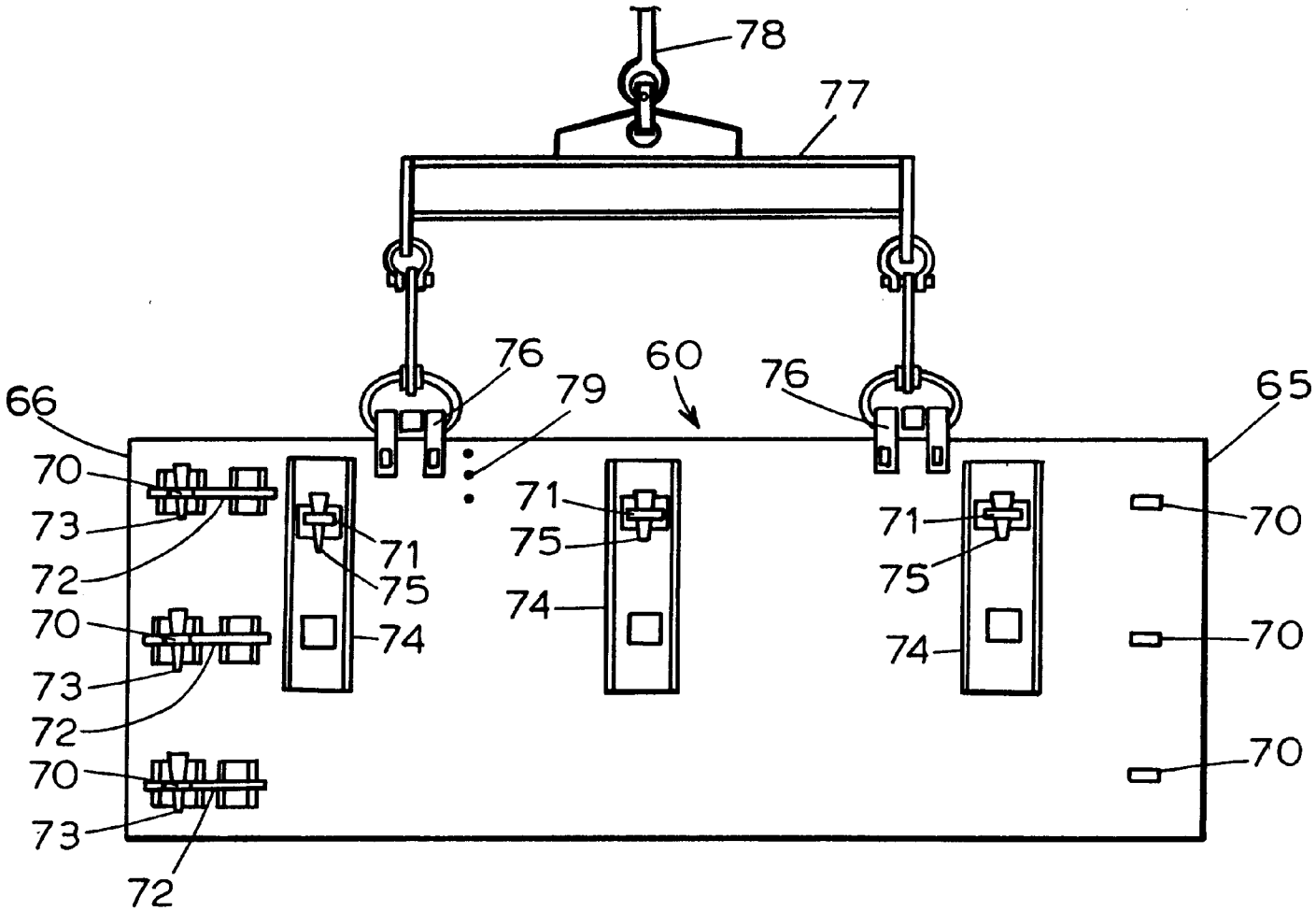
FIG. 4 is an elevational view of the outside surface of a first ring shell plate prior to its placement the first shell ring.

As seen in FIG. 4, six vertical seam key nuts [70] are tack-welded to the surface of each first ring shell plate [60] prior to placement of the plate on the tank bottom [12]. Three of these vertical seam key nuts [70] are located near one lateral edge [65] of the plate and three others are located near the opposite edge [66]. The number of vertical seam key nuts [70] may vary, depending, for example, on the height of the plates being used. The illustrated arrangement is useful for 8 foot by 30 foot plates. For a 10 foot by 40 foot plate, it may be desirable to use four vertical seam key nuts [70] on each edge. A key plate [72] is attached to each of the vertical seam key nuts [70] on one edge [66]. As illustrated, the key plates [72] are attached to the key nuts [70] with vertical seam key pins [73].

Three girth seam key nuts [71] are also tack-welded to the surface of each first ring shell plate [60] near its upper edge. The number of girth seam key nuts [71] may also vary, depending, for example, on the length of the plates being used. For a 10 foot by 40 foot plate, it may be desirable to use four girth seam key nuts [71] on each plate. A key channel [74] is temporarily hung on each of the girth seam key nuts [71]. As illustrated, the key channels [74] are attached with girth seam key pins [75]. Key channels [74] such as those described by Hines, U.S. Pat. No. 2,101,856 may be used for this purpose. Other types of temporary stiffeners may also be used.

Along the top edge of each first ring shell plate [60], placement points [79] may be marked to indicate the placement of the vertical seams for the overlying ring. As illustrated in FIG. 4, the marks have been made at distances approximately one-third of the shell plate length from one of the lateral edges [66] of the shell plate.

Placing the First Ring Shell Plates

With proper lifting equipment, such as a crane, the first ring shell plates [60] are lifted into their marked locations on the tank bottom [12] using plate clamps [76] that are attached to the top of the first ring shell plate [60]. The non-marking clamp, described by Olsen, U.S. Pat. No. 3,120,046 may be used for this purpose. As shown, a spreader bar [77] is attached to the two plate clamps [76] and a cable [78] from the crane is attached to the spreader bar [77].

As seen in FIG. 2, an initial shell plate [61] is set into position between the outside key nuts [44] and the inside key nuts [45] at a radius allowing for a normal gap between the vertical edges of adjacent plates. The positioning of the outside key nuts [44] outwardly from the first ring outside circumference [51] permits key bull-pins [52] to be inserted between the key nuts [44] and the shell plate [61]. The shell plate [61] may then be plumbed, and, if desired, key channel knee braces [63] can be tack-welded [64] to the shell plate [61] and to the tank bottom [12] to provide temporary support.

As illustrated, an adjacent shell plate [62] is set into position adjacent the initial shell plate [61], with a trailing edge [66] of the adjacent shell plate [62] adjacent to the leading edge of the initial shell plate [61]. The bottom edge of the adjacent shell plate [62] is set into position between outside key nuts [44] and inside key nuts [45] on the annular plates [32], and is secured with bull-pins [52] as described above.

Figure 5:
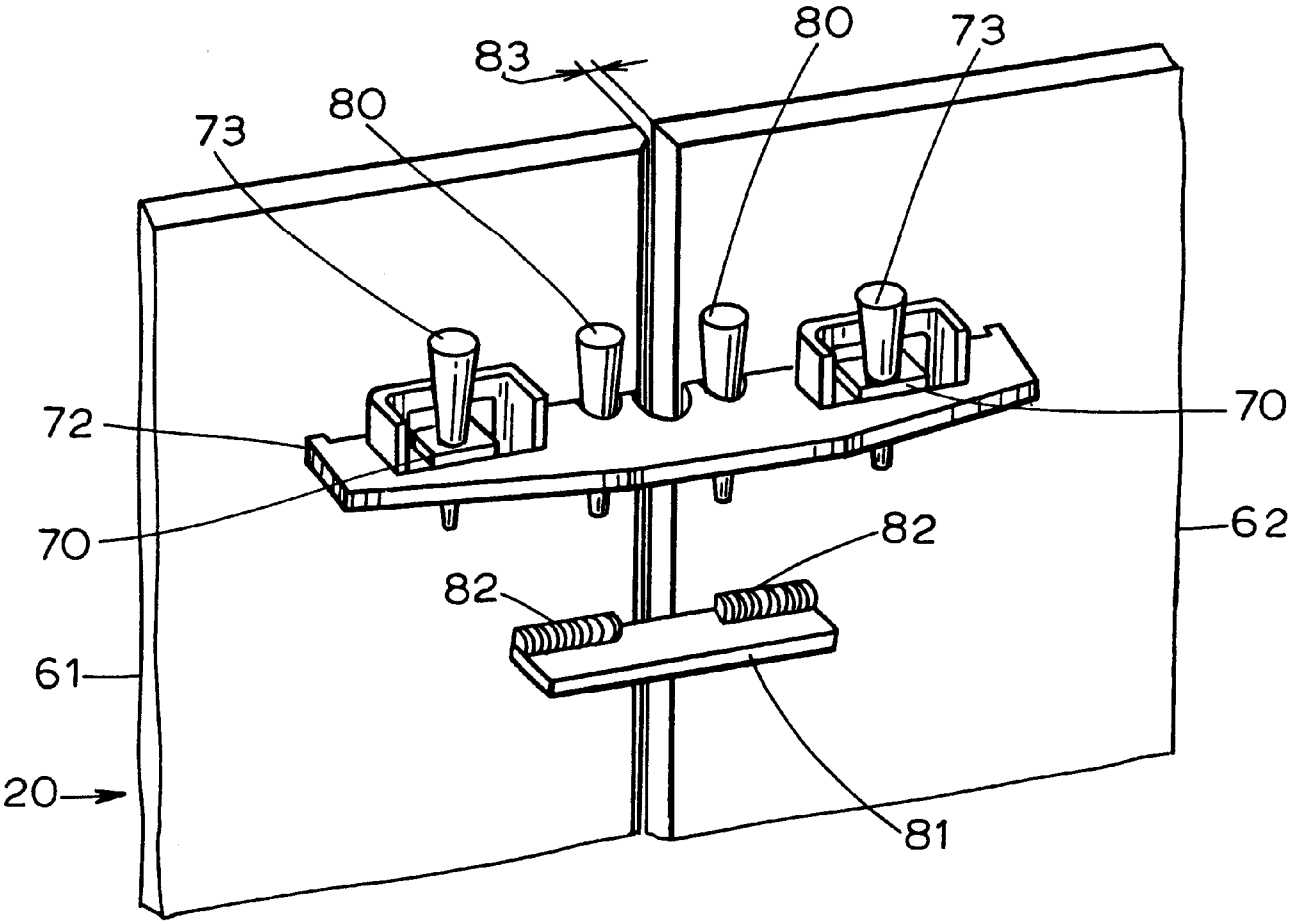
FIG. 5 is an isometric view of a key plate that may be used to join and fit a vertical seam between adjacent shell plates.

After the adjacent shell plate is set in position, the key plates [72] that are attached to the vertical seam key nuts [70] on the trailing edge [66] of the adjacent shell plate [62] are attached to the vertical seam key nuts [70] on the leading edge [65] of the initial shell plate [61]. As seen in FIG. 5, key pins [73] are used to join the vertical seam key nuts [70] to the key plate [72]. After the adjacent shell plate [62] is secured to the initial shell plate [61] with the key plates [72], the plate clamps [76] used for lifting the shell plate may be loosened and removed.

Key plates can be provided in a variety of other ways. For example, instead of fastening the key plates used to join the initial shell plate [61] and the adjacent shell plate [62] on the leading edge [65] of the initial shell plate [61], they could be first fastened to the trailing edge [66] of the adjacent plate [62]. Another alternative would be to hang some shell plates with no key channels, and other plates with key channels on both the leading and trailing edges.

Fitting and Welding the First Ring Vertical Seams

The first ring vertical seams can begin to be fitted as soon as two first ring shell plates [60] have been hung. Fitting involves adjusting the plates so the vertical seam will have a proper weld gap [83] before being welded, and so the inside and outside shell plate surfaces at the ends of two adjacent shell plates will be flush. As seen in FIG. 5, the insertion of two flushing key pins [80] allows adjustments to be made to the fit of the ends of two adjacent shell plates to achieve a flush fit. Once the vertical seam weld gap [83] has been set and the adjacent shell plates are made flush, a finger bar [81] can be attached to the adjacent shell plates with finger bar welds [82], as shown in FIG. 5, completing the fit.

After a vertical seam has been fit, it may be welded. It is easiest to first weld a vertical seam on the side of the plates opposite the side on which the key plates [72] are mounted. Thus, when fitting is done from outside the tank, the inside of the tank shell [13] is generally welded first. When a seam has been fit from inside the tank, the outside of the seam is generally welded first. Automatic vertical welding equipment, such as that described by Christensen, et al, U.S. Pat. No. 2,794,901, Arnold, et al, U.S. Pat. No. 3,210,520, Yadron, et al, U.S. Pat. No. 3,255,944, or Rainey, U.S. Pat. No. 3,444,349 can be used to improve the quality and productivity of vertical seam welds.

When the surface of the vertical seam on one side of the tank shell [13] has been welded, key plates [72] and finger bars [81] can be removed from the opposite side to facilitate welding of that side.

When this method is used, weld shrinkage causes the shell plates to wrap tightly around the inside key nuts [45] at the desired inside circumference. Completing all vertical seam welding in the first ring helps prevent ovaling or flattening of the shell. However, with the present invention, it is not necessary to complete all vertical seam welding in the first ring before beginning to hang plates in the second ring [21].

Preparing the Second and Upper Ring Shell Plates

Figure 8:
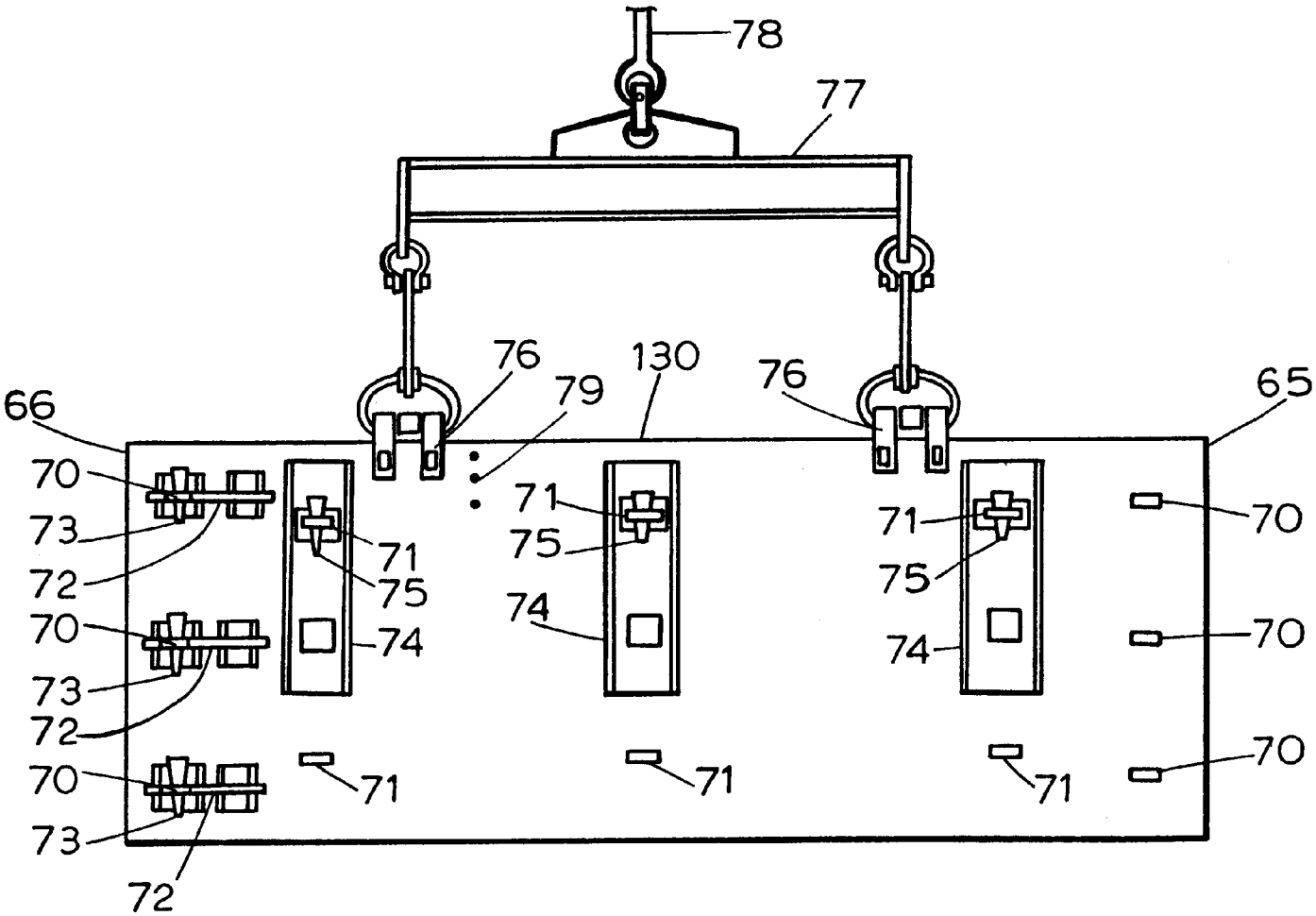
FIG. 8 is an elevational view of the outside surface of a second ring shell plate prior to its placement in the shell ring.

FIG. 8 shows the outside surface of a second ring shell plate [130] just prior to its placement at its proper location on top of the first shell ring [20]. The second ring shell plates [130] are prepared in a manner similar to that used to prepare the first ring shell plates [60], except that three additional girth seam key nuts [71] are attached near the bottom of the second ring shell plates [130] at the locations that will correspond with the girth seam key nuts on the first ring shell plates, as seen in FIG. 8. These nuts can be attached before or after the plate is hung.

Placing the Second and Upper Ring Shell Plates

Figure 9:
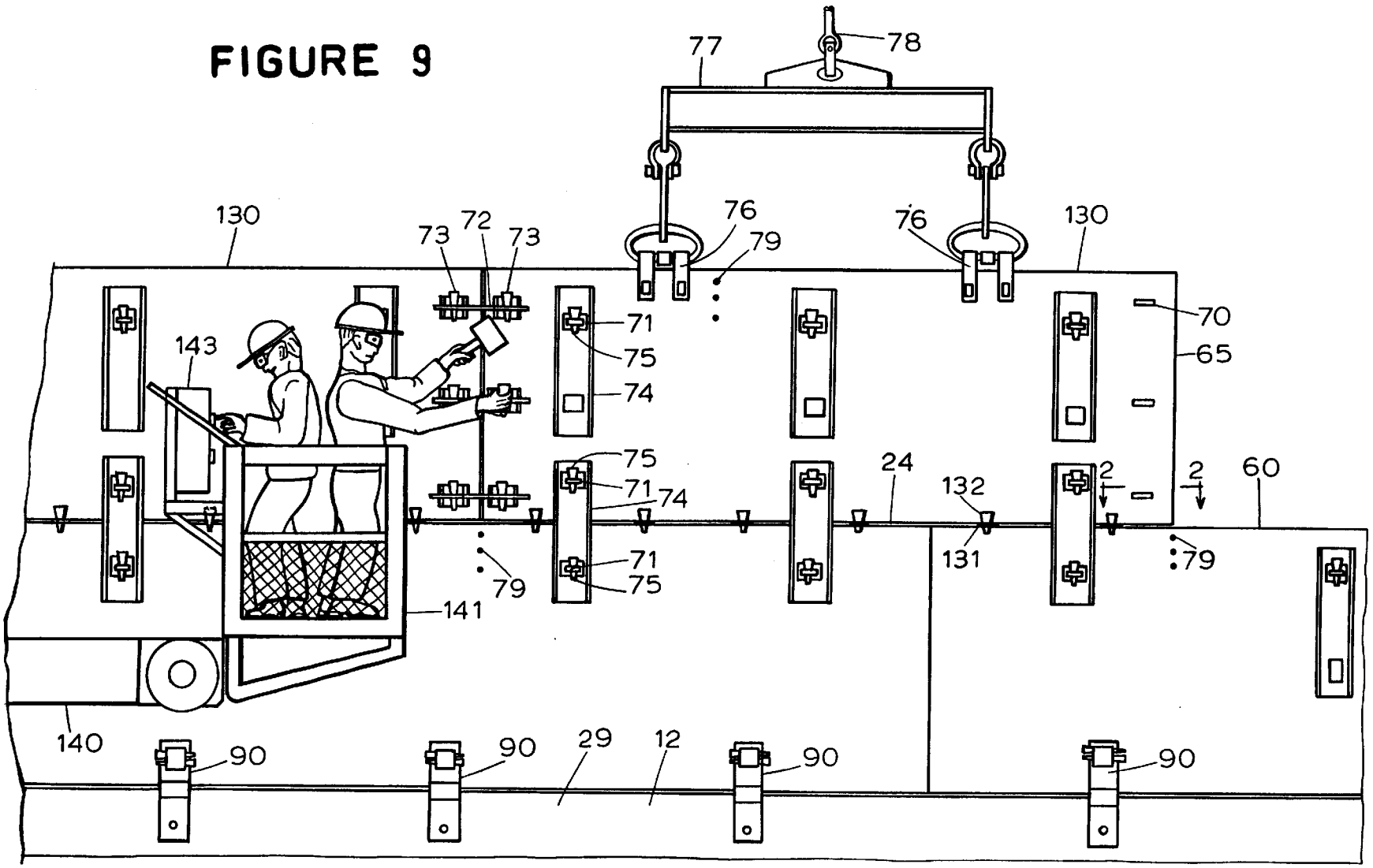
FIG. 9 is an elevational view of the tank shell during the placement of a second ring shell plate.

FIG. 9 shows the placement of an upper ring shell plate [130]. As illustrated, a crane is used to position a trailing edge [66] of the upper ring shell plate [130] in its appropriate position [79] on the top edge of the appropriate underlying ring shell plate [60]. Preferably, the plate is lifted and moved into position by the crane in a vertically plumb position, with the trailing edge [66] slightly lower than the leading edge (about 6 to 8 inches).

Access of construction personnel to the second ring shell plates [130] can usually be provided by placing a personnel basket on the forks of a fork lift. Access to higher rings is provided by a lift, such as a mobile manlift [140] that has a personnel basket [141] that can preferably accommodate at least 2 construction personnel. The personnel basket [141] is equipped with movement controls [143] that permit construction personnel in the personnel basket [141] to move the location of the lift personnel basket [141] to permit close access to the different portions of shell plates during the tank shell erection. Marking a circular track on the ground where the manlift will operate may provide a reference to personnel in the basket that is useful in guiding movement of the manlift. As illustrated, the manlift is positioned outside the tank shell. It may be preferable, however, to place the manlift inside the shell so it can freely operate without interfering with the crane, which typically operates outside the tank shell. Operating the manlift from inside the shell requires that a doorsheet be included in the first ring [20] to permit removal of the manlift after the shell [13] is erected.

For safety, bumper guards may be hung outside the basket [141] to minimize the risk of injury caused by the basket accidentally striking the shell [13].

When a trailing edge [66] of the upper ring shell plate [130] is in position, a worker in the basket [141] secures the lowermost key plate on the trailing edge [66] of the plate to the leading edge of the previously hung adjacent plate in the upper ring. A worker then places girth seam shims [131] in the girth seam [24] between the overlying ring shell plate [130] and the underlying first ring shell plates [60] as the crane operator lowers the leading edge [65] into position, generally working from the trailing edge [66] toward the leading edge [65].

Figure 10:
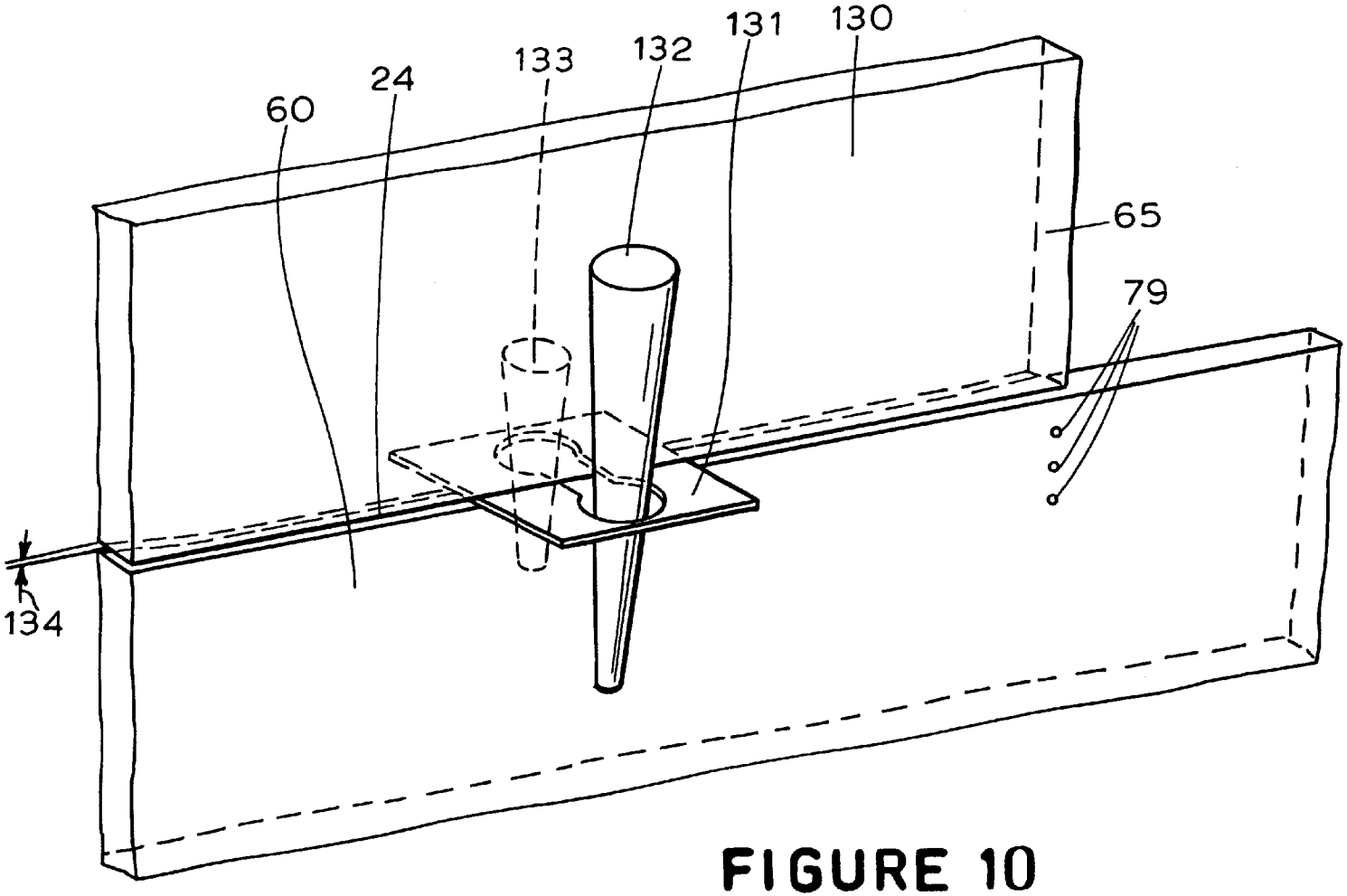
FIG. 10 is an isometric view of section 2—2 in FIG. 9, illustrating the placement of a typical girth seam shim.

FIG. 10 illustrates the placement of a typical girth seam shim [131]. The thickness of the girth seam shim [131] is selected to result in the proper girth seam weld gap [134] for later welding the seam. The girth seam shim [131] is held in position by a girth seam shim retainer pin [133] that is placed on one side of the girth seam [24] and by a girth seam shim pin [132] that is placed on the other side of the girth seam [24]. As illustrated in FIG. 9, the girth seam shims [131] are typically installed at 4 foot intervals along a girth seam.

The key channels [74] are preferably secured after the girth seam shims [131] are in place, working backwards from the leading edge [65] back to the trailing edge [66]. The key channel [74] that is near the trailing edge [66] of the initial shell plate in a ring is generally tack-welded to the shell plates. For subsequent shell plates in a ring, key plates [72] between adjacent overlying shell plates [130] are preferably secured after workers return to the trailing edge after securing the key channels [74]. Vertical seam key pins [73] are used to secure the key plates [72] to the vertical seam key nuts [70] on the shell plates [130].

After an overlying shell plate [130] is secured to the underlying shell plates [60] with key channels [74] and to the adjacent overlying shell plate [130] with key plates [72], the plate clamps [76] used to move the plate into position may be loosened and removed, so work may begin on hanging another shell plate.

Shell plates in upper rings may be hung before all plates in a lower ring are hung. This permits a reduction in the amount of crane movement needed.

For large tanks, it has been found that a spiraling technique, in which work proceeds on two rings simultaneously (something that is difficult when using a scaffold), is surprisingly efficient, leading to extraordinarily quick construction times. A shortened construction schedule reduces the time that the manlift needs to be on site, helping to minimize costs.

Fitting and Welding the Second and Upper Ring Vertical Seams

Fitting of the second and upper ring vertical seams can begin as soon as at least three shell plates [130] in the ring have been hung. The same vertical seam fitting procedure that was used for the first ring vertical seams may be used. Workers can obtain access to the vertical seams in the second ring [21] by a basket on a forklift, and to vertical seams in higher rings by a basket on a manlift or, preferably, by construction carriages that roll on the top edge of a shell ring. A seam fit-up carriage [150] can be used to provide access to the vertical seams and girth seams for seam fit-up by construction personnel. The seam fit-up carriage [150] may be lifted and placed onto the top edge of a shell ring by a crane [142], and rolls on the top edge of the shell plates by the use of carriage wheels [157]. In order to better distribute weight, it may be advantageous to use double-sided carriages to provide access to both sides of the shell simultaneously.

After a vertical seam has been fit, it may be welded. Welding the second ring vertical seams may be performed in a manner similar to that used on the first ring vertical seams. Preferably, access to seams in upper rings is provided by construction carriages, such as those shown in FIG. 11

Figure 11:
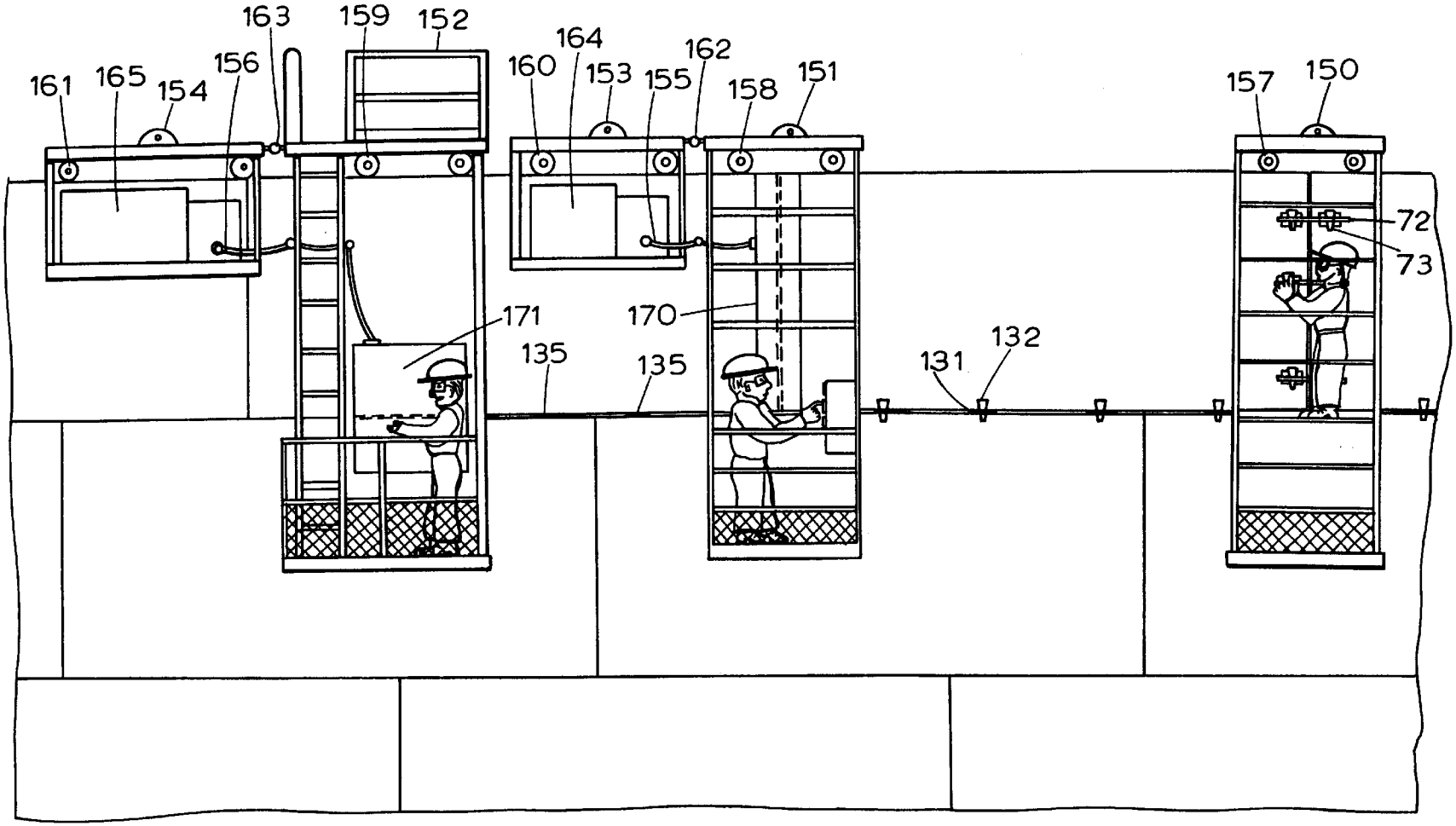
FIG. 11 is an elevational view of the tank shell while construction carriages are used in se fit-up automatic vertical seam welding, and automatic girth seam welding.

A vertical seam welding carriage [151] such as the one illustrated in FIG. 11 can be used to support an automatic vertical seam welder [170] and welding personnel. The illustrated vertical seam welding carriage [151] may be placed on the top edge of a shell ring by a crane [142], and can roll on carriage wheels [158] riding on the top edge of the shell plates. A vertical seam mobile power source carriage [153] riding on wheels [160] may be used to support welding power source equipment [164]. A carriage hitch [162] may be used to join the vertical seam welding carriage [151] to the vertical seam mobile power source carriage [153]. A welding power cable [155] may be used to connect the welding power source equipment [164] to the automatic vertical seam welder [170]. Again, it may be advantageous to use double-sided carriages.

Fitting and Welding Girth Seams

A girth seam may be fitted and tack-welded as soon as at least three overlying shell plates [130] have been hung. The fitting and welding may begin at the initial overlying shell plate [130] and proceed in either direction around the girth seam [24]. It is preferred that welding proceed in the same direction that plates are being hung.

Fitting girth seams requires that consideration be given to both alignment of the two adjoining shell plates (i.e., the underlying shell plate [60] and the overlying shell plate [130]) and variation of the girth seam weld gap [134]. The relative flushness of the outside surface of the two adjoining shell plates may be adjusted by varying the vertical position of the girth seam shim pin [132] in the girth seam shim [131].

Girth seams [24] should not be fit past any overlying ring vertical seam that has not yet been completely welded, and fitting preferably stops about 3 feet from an unwelded vertical seam.

After being fitted, the girth seam is preferably first tack-welded. The girth seam tack welds [135] may be between 1 and 2 inches in length, and should be spaced apart by no more than about 2 feet. As the tack welds [135] are made, the adjacent girth seam shims [131] may be removed.

Final welding is preferably done by an automatic girth welder. A girth seam welding carriage [152] like the vertical seam welding carriage [151], and riding on wheels [159], can be used to support an automatic girth seam welder [171] and welding personnel. It can be accompanied by a girth seam mobile power source carriage [154] like the vertical seam mobile power source carriage [153], and riding on wheels [161], with a carriage hitch [163] and a welding power cable [156] connecting welding power supply equipment [165] to the automatic girth seam welder [171]. Preferably, a double-sided automatic girth welder is used to weld both sides of the girth seam simultaneously.

The mobile power sources may be like those described in Sugimoto, et al, U.S. Pat. No. 4,952,774.

Because of the length of time needed to prepare an automatic girth welder [171] for operation, it is generally desirable to hang the automatic girth welder and begin preparation for girth welding as soon as possible. Preferably, the automatic girth welder [171] is hung as soon as three plates in a ring have been hung and fit.

Fitting and Welding the Corner Seam

In this method, the corner seam need not be welded before the third ring [22] is hung. At any time after one side of the corner seam [27] has been welded and leak tested, the other side of the corner seam [27] may be welded and, if necessary, leak-tested.

Installing the Shell Anchors

To avoid wind-induced buckling of the tank shell [13] during scaffold less tank construction, it may be important to provide temporary stiffening to the shell [13]. It has been found that the need for temporary stiffening is generally a function of ambient wind speed and the diameter and height of the tank. Typically, such stiffening would not be necessary until the tank is approximately 20 to 30 feet high.

One way to provide stiffening is to anchor the tank shell [13] to the foundation [11]. For example, a series of tank shell anchors [90] may be attached to the bottom of the first shell ring [20] and to the foundation [11]. These shell anchors [90] may be equally spaced around the entire first shell ring [20]. Later, after construction has been completed, these shell anchors [90] may be removed.

Figure 6:
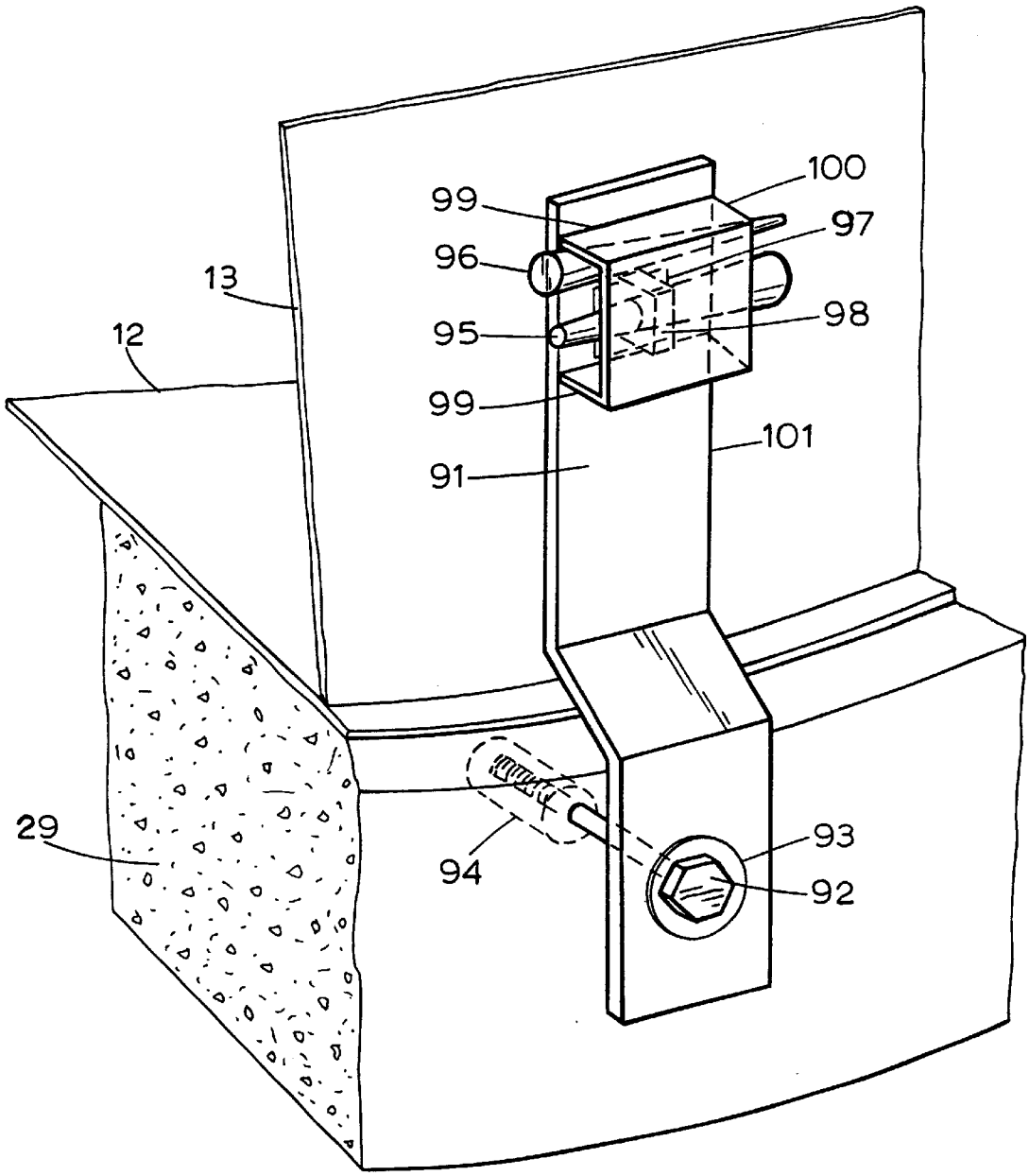
FIG. 6 is an isometric view of a type of shell anchor strap that may be attached to a concrete ringwall.

FIG. 6 shows a type of shell anchor [101] that consists of an anchor strap [91] that is attached to the foundation concrete ringwall [29] by an anchor bolt [92]. The anchor strap [91] is attached to the tank shell [13] by a shell anchor nut [98] that is welded to the tank shell [13] near the bottom of the first shell ring [20]. The shell anchor nut [98] extends through an opening [97] in the anchor strap [91], and is secured to the anchor strap [91] by an anchor key pin [95]. The anchor bolt [92] penetrates a circular hole in the anchor strap [91] and extends into the concrete ringwall [29] to an anchor bolt retainer [94]. A washer [93] is placed under the head of the anchor bolt [92]. Optionally, a cover [100] may be placed over the anchor strap opening [97] and joined to the anchor strap [91] by welds [99]. To increase the tension in the anchor strap [91], a tensioning key pin [96] can be forced between an edge of the cover [100] and the shell anchor nut [98].

Figure 7:
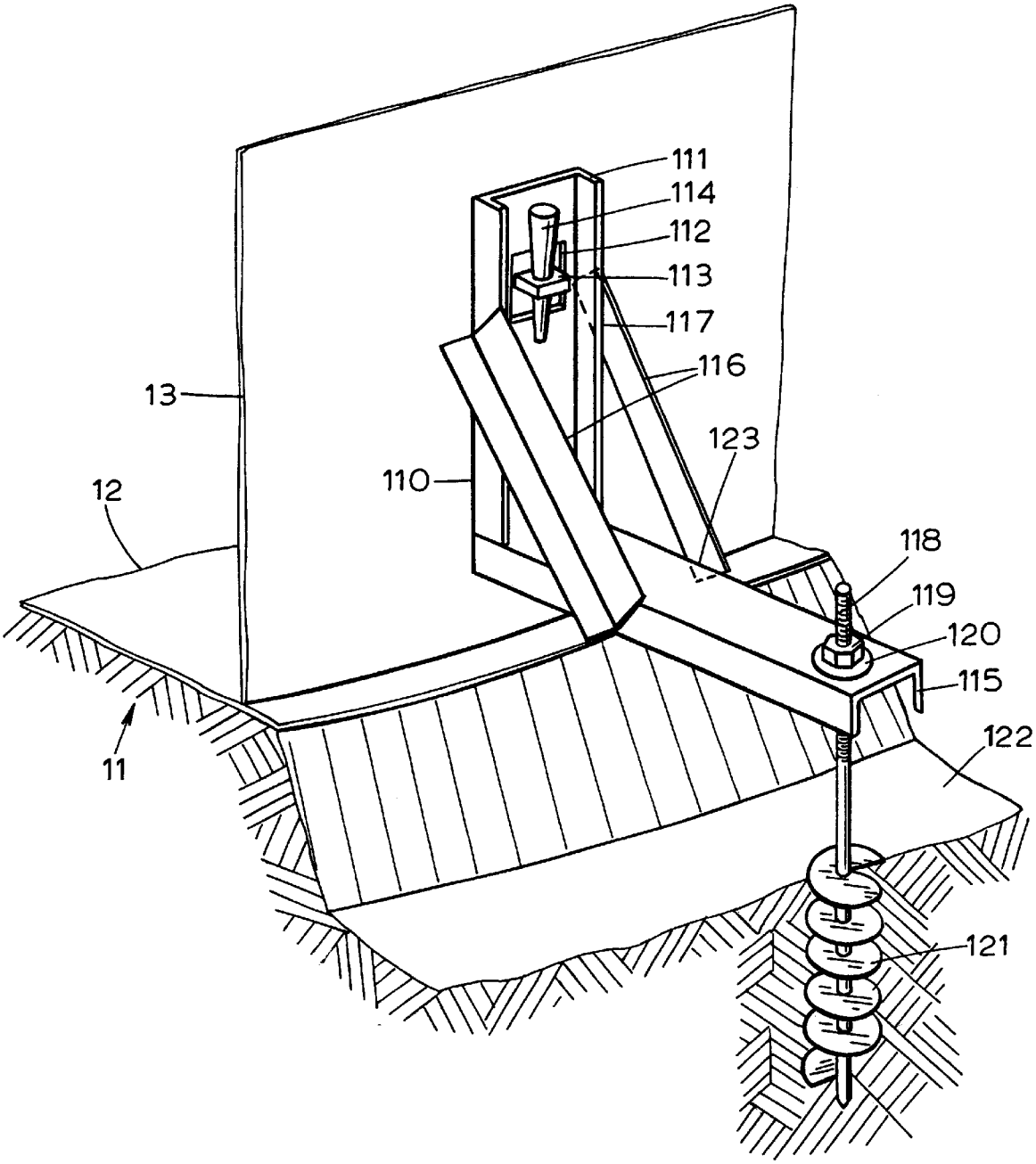
FIG. 7 is an isometric view of a type of shell anchor that may be attached to the soil.

FIG. 7 shows a type of shell anchor [110] that consists of an anchor key channel [111] with an anchor tensioning arm [115] that is attached to the soil [122] adjacent to the tank foundation [11] by an auger soil anchor [121]. The anchor key channel [111] is attached to the tank shell [13] by a shell anchor nut [113] that is welded to the tank shell [13] near the bottom of the first shell ring [20]. The shell anchor nut [113] extends through an opening [112] in the anchor key channel [111], and is secured to the anchor key channel [111] by an anchor key pin [114]. An anchor tensioning arm [115] is attached to and extends outwardly from the anchor key channel [111]. Side braces [116] are joined to the anchor key channel [111] and to the anchor tensioning arm [115] by welds [117,123] or by a turnbuckle. A threaded anchor bolt [118] is joined to the auger soil anchor [121], and extends vertically upward through a circular hole in the anchor tensioning arm [115]. The threaded anchor bolt [118] is joined to the anchor tensioning arm [115] by an anchor nut [119] that rests on a washer [120]. Tension applied by this type of shell anchor [110] may be increased by tightening the anchor nut [118].

A shell anchor could also take other forms. For example, it could take the form of an embed plate in a vertical face of a ringwall, or of a hairpin anchor through the top face of concrete that can be connected to a lug on the tank with a turnbuckle and cut off and grouted when construction is complete.

Figure 13:
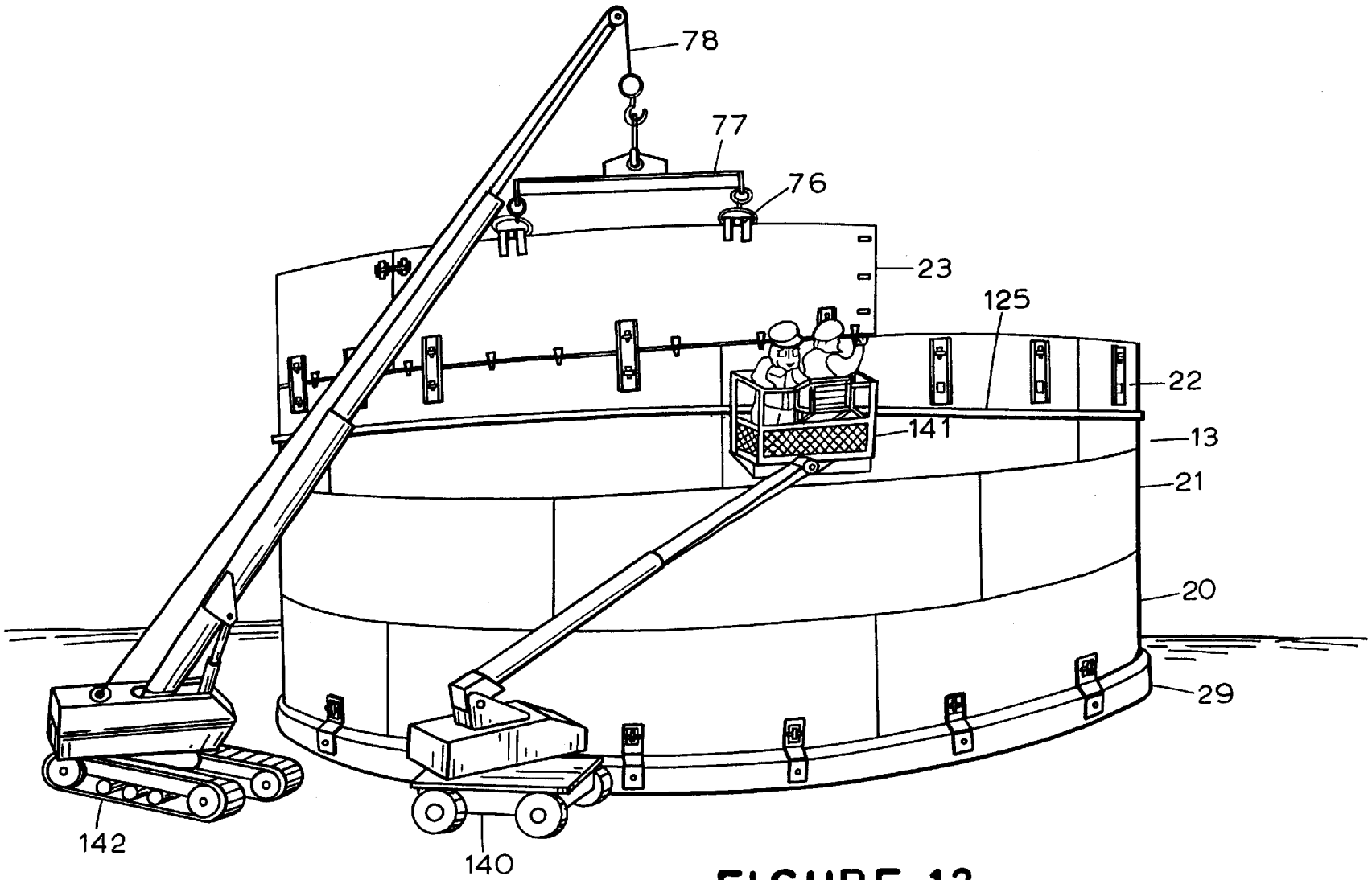
FIG. 13 shows a top angle being used as a temporary stiffener.

Stiffening can also be provided by adding guy lines or a temporary stiffener to the side of the structure. If the tank is designed to include a top angle [14], or comparable stiffener member to stiffen the upper rim of the tank, it may be useful to temporarily mount the stiffener member at an intermediate location on the tank to provide temporary stiffening. FIG. 13 illustrates a top angle [125] mounted at an intermediate location.

Preparing, Placing, Fitting, and Welding the Top Ring

Figure 12:
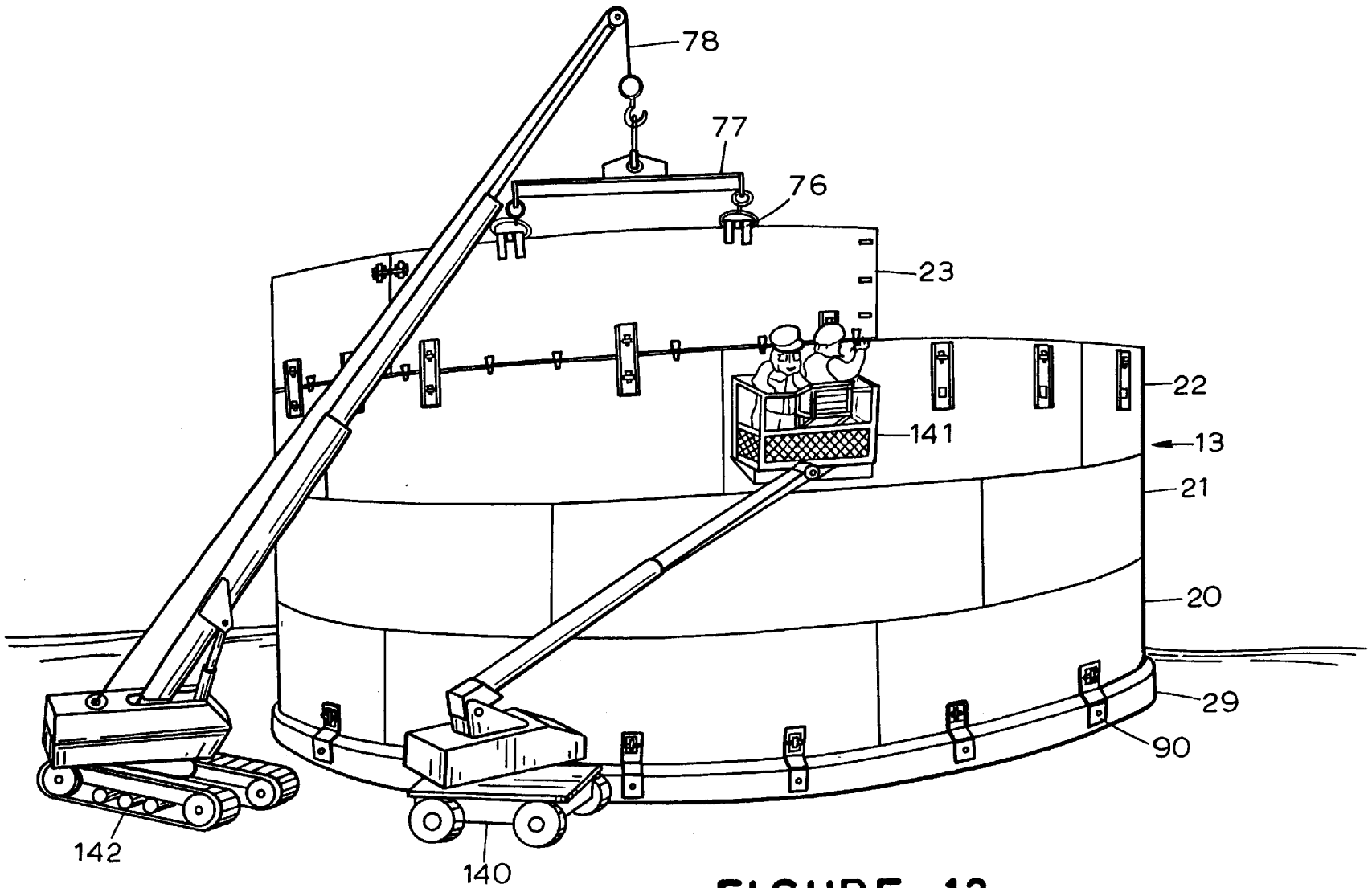
FIG. 12 is an isometric view of an aboveground storage tank showing placement of a top ring.

FIG. 12 shows the erection of the top ring [23].

The top ring shell plates are prepared and hung in a manner similar to the upper ring shell plates [130], except that no upper girth seam key nuts [71] or key channels [74] need be attached to the upper edge of the top ring shell plate.

The vertical seams in the top ring and the girth seams at the lower edge of the top ring are fit and welded in a manner similar to that used for the upper rings [21].

Completion

After the top ring vertical seams and girth seam have been welded, a top angle [14] may be placed and fit for fixed roof tanks. For floating roof tanks, a wind girder may be added. The installation of these structures will generally provide sufficient stiffening to allow the temporary stiffeners to be removed.

As seen in FIG. 1, a fixed roof [15] may be erected upon the top angle [14]. As illustrated, the outer perimeter of the fixed roof [15] is welded to the horizontal leg of the top angle [14]. The manlift [140] may be used to assist in construction of the roof without a scaffold.

Once its use is finished, the manlift [140], if positioned inside the shell, may be removed through the doorsheet, which may then be sealed in a conventional way.

This description has been given for clarity of understanding only, and no unnecessary limitations should be understood therefrom, as modifications would be obvious to those skilled in the art.

What is claimed is:

1. A method for building a storage tank without the need for erecting a stationary scaffold, the method comprising the steps of:

placing shell plates in a first ring;

providing temporary stiffening to the shell plates;

placing shell plates in an upper ring above the first ring; and using a lift to provide construction personnel with access to the shell plates in the upper ring for setting the shell plates and fitting seams in the upper ring.

2. A method as recited in claim 1, in which the shell plates in the first ring are placed by a method comprised of:

setting an inside positioner on a tank bottom at a desired final inside shell radius, and an outside positioner at an outside radius that is approximately ¾ inches outwardly from a desired final outside shell radius;

positioning the shell plates at a radius allowing for a normal gap between the shell plates; and welding the plates together so that weld shrinkage causes the plates to wrap tightly around the inside positioner.

3. A method for building a storage tank without the need for erecting a stationary scaffold, the method comprising the steps of:

placing shell plates in a first ring;

placing shell plates in an upper ring above the first ring;

using a lift to provide construction personnel with access to the shell plates in the upper ring for setting the shell plates and fitting seams in the upper ring; and assessing wind conditions by evaluating ambient wind speed in association with the diameter and height of the tank to determine if temporary stiffening is required.

4. A method for building a storage tank without the need for erecting a stationary scaffold, the method comprising the steps of:

placing shell plates in a first ring;

placing shell plates in an upper ring above the first ring;

using a lift to provide construction personnel with access to the shell plates in the upper ring for setting the shell plates and fitting seams in the upper ring; and providing temporary stiffening by installing shell anchors to the shell plates in the first ring.

5. A method for building a storage tank without the need for erecting a stationary scaffold, the method comprising the steps of:

placing shell plates in a first ring;

placing shell plates in an upper ring above the first ring;

using a lift to provide construction personnel with access to the shell plates in the upper ring for setting the shell plates and fitting seams in the upper ring; and providing temporary stiffening by temporarily installing a stiffener member at an intermediate position on the shell.

6. A method as recited in claim 1, in which the lift is positioned inside the tank.

7. A method as recited in claim 1, in which the shell plates for the upper ring are placed on an underlying ring, and at least some of the shell plates for the upper ring are placed before all vertical seams in the underlying ring are welded.

8. A method as recited in claim 1, in which:

the shell plates for the upper ring are placed on an underlying ring;

an initial set of shell plates for the upper ring are placed before vertical seams in the supporting ring are welded; and an automatic girth welder is suspended from the shell plates in the upper ring and prepared for operation while vertical seams in the supporting ring are being welded.

9. A method as recited in claim 1, in which:

the lift is positioned inside the tank;

after use of the lift is completed, the lift is removed from the tank; and a doorsheet is replaced after the lift is removed.

10. A method as recited in claim 1, in which at least a portion of a roof is hung using the lift.

11. A method as recited in claim 1, in which:

a double-sided carriage is used as a platform for providing access to seams in the upper ring.

12. A method as recited in claim 1, in which temporary stiffeners are temporarily attached to keynuts on the shell plates in the upper ring before the shell plates are hung.

13. A method as recited in claim 1, in which the lift comprises a basket, and bumper guards are hung outside the basket to minimize the risk of injury caused by the basket accidentally striking the shell.

14. A method as recited in claim 1, in which a shell plate is hung on a lower ring of shell plates by a method comprised of:

positioning the shell plate with a trailing edge adjacent a leading edge on a previously-installed shell plate in the same ring, approximately 6 to 8 inches lower than an opposite, leading edge on the plate being hung;

inserting shims approximately every few feet between the shell plate and the lower ring of shell plates as the leading edge is lowered into position;

installing key channels after the plate is set on the shims; and securing a key plate joining the shell plate and the previously-installed shell plate, near the trailing comer.

15. A method as recited in claim 1, in which a circular track is marked at a set distance from a circumference of the shell plates and used for guiding movement of the lift.

16. A method for building a storage tank without a scaffold, the method comprising the steps of:

positioning a lift inside the periphery of the tank;

placing shell plates in a first ring;

providing temporary stiffening to some of the shell plates;

placing shell plates in an upper ring above the first ring;

using the lift to provide construction personnel with access to the shell plates in the upper ring for setting the shell plates and fitting seams in the upper ring;

removing the lift through an opening in the tank after substantially all of the shell plates have been placed; and sealing the opening after the lift is removed.

17. A method as recited in claim 16, in which the tank is built on a foundation and temporary stiffening is provided by installing shell anchors that have one end that is attached to a shell plate, and another end that is attached to the foundation.

18. A method as recited in claim 16, in which temporary stiffening is provided by installing shell anchors that have one end that is attached to a shell plate, and another end that is fixed in the soil.

19. A method as recited in claim 16, in which the tank comprises a stiffener member for the top of the shell, and temporary stiffening is provided by temporarily installing the stiffener member at an intermediate position on the tank.

20. A method for building a storage tank without a scaffold, the method comprising the steps of:

placing shell plates in a first ring;

assessing wind conditions to determine if additional stiffening is desirable to reduce the risk of the placed shell plates buckling as a result of wind-produced air pressure differentials and, when it is determined that additional stiffening is desirable, providing temporary stiffening to the shell plates;

placing shell plates in an upper ring above the first ring;

using a lift to provide construction personnel with access to the shell plates in the upper ring for setting the shell plates and fitting seams in the upper ring; and suspending a carriage from an upper plate edge, and using the carriage as a platform for welding seams in the upper ring.

21. A method as recited in claim 20, in which the carriage comprises a mobile power source.

22. A method as recited in claim 20, in which the carriage is connected to a separate mobile power source carriage that is suspended from the upper plate edge and is equipped with a mobile power source.

23. A method as recited in claim 20, in which the carriage is double-sided, has an inside frame that rides about 8" away from the shell plates, has a top side platform to allow cross-over between the sides of the carriage and provide access to shell plates during placement, and has horizontal members configured to serve as a ladder.

24. A method as recited in claim 20, in which the temporary stiffening is provided.

* * * * *